US012281660B2

(12) United States Patent
Short et al.

(10) Patent No.: US 12,281,660 B2
(45) Date of Patent: Apr. 22, 2025

(54) EJECTOR DEVICE

(71) Applicant: TRANSVAC SYSTEMS LIMITED, Alfreton (GB)

(72) Inventors: Gary Anthony Short, Nottinghamshire (GB); Jacob Thomas Roberts, Nottinghamshire (GB)

(73) Assignee: TRANSVAC SYSTEMS LIMITED, Alfreton (GB)

( * ) Notice: Subject to any disclaimer, the term of this patent is extended or adjusted under 35 U.S.C. 154(b) by 93 days.

(21) Appl. No.: 17/772,315

(22) PCT Filed: Nov. 5, 2020

(86) PCT No.: PCT/GB2020/052796
§ 371 (c)(1),
(2) Date: Apr. 27, 2022

(87) PCT Pub. No.: WO2021/090004
PCT Pub. Date: May 14, 2021

(65) Prior Publication Data

US 2022/0364577 A1 Nov. 17, 2022

(30) Foreign Application Priority Data

Nov. 5, 2019 (GB) ..... 1916064

(51) Int. Cl.
*F04F 5/10* (2006.01)
*F04F 5/04* (2006.01)
(Continued)

(52) U.S. Cl.
CPC ..... *F04F 5/10* (2013.01); *F04F 5/04* (2013.01); *F04F 5/24* (2013.01); *F04F 5/466* (2013.01); *F04F 5/20* (2013.01); *F04F 5/463* (2013.01)

(58) Field of Classification Search
CPC ..... F04F 5/10; F04F 5/04; F04F 5/14; F04F 5/16; F04F 5/24; F04F 5/466; F04F 5/02;
(Continued)

(56) References Cited

U.S. PATENT DOCUMENTS 2,378,425 A 6/1945 Lamont
2,582,069 A * 1/1952 Rose ..... F04F 5/463 417/181

(Continued)

FOREIGN PATENT DOCUMENTS

EP 1064464 A2 1/2001
GB 2384027 B 4/2006

(Continued)

OTHER PUBLICATIONS

Examination Report corresponding to GB Application No. 2017485.0 (4 pages) (Jun. 30, 2022).

(Continued)

*Primary Examiner* — David N Brandt
(74) *Attorney, Agent, or Firm* — Myers Bigel, P.A.

(57) ABSTRACT

An ejector device comprises a housing (110) having a motive fluid inlet (111) to receive motive fluid, a suction fluid inlet (112) to receive suction fluid and a fluid outlet (113) to output the motive fluid and the suction fluid. The ejector device comprises a nozzle and diffuser assembly (150) configured to fit within the housing (110). The nozzle and diffuser assembly (150) comprises a nozzle (160), a diffuser (170) and a connecting structure (180) connecting the nozzle (160) to the diffuser 170. The connecting structure (180) is configured to permit fluid flow between the nozzle (160) and the diffuser (170). The connecting structure (180) has apertures (182) configured to allow fluid to be drawn into the fluid flow between the nozzle 160 and the diffuser (170).

17 Claims, 8 Drawing Sheets

(51) Int. Cl.

| | |
|---|---|
| ***F04F 5/20*** | (2006.01) |
| ***F04F 5/24*** | (2006.01) |
| ***F04F 5/46*** | (2006.01) |

(58) Field of Classification Search
CPC ..... F04F 5/20; F04F 5/46; F04F 5/44; F04F 5/463
See application file for complete search history.

(56) References Cited

U.S. PATENT DOCUMENTS

| | | | | |
|---|---|---|---|---|
| 2,701,681 | A | 2/1955 | Lamont | |
| 6,276,903 | B1 * | 8/2001 | Popov | F04F 5/466 417/198 |
| 2009/0297367 | A1 * | 12/2009 | Yamada | F04F 5/14 417/151 |
| 2014/0255218 | A1 * | 9/2014 | Sarshar | F04F 5/54 417/198 |
| 2015/0308461 | A1 | 10/2015 | Tell | |
| 2017/0037874 | A1 * | 2/2017 | Cho | F04F 5/464 |

FOREIGN PATENT DOCUMENTS

| | | | |
|---|---|---|---|
| GB | 2509184 | A | 6/2014 |
| GB | 2524499 | A | 9/2015 |
| GB | 2590183 | B | 3/2023 |
| WO | 9949216 | A1 | 9/1999 |
| WO | 2012059773 | A2 | 5/2012 |
| WO | 2018130818 | A1 | 7/2018 |

OTHER PUBLICATIONS

Combined Search and Examination Report corresponding to GB Application No. 1916064.7 (5 pages) (May 15, 2020).
Combined Search and Examination Report corresponding to GB Application No. 2017485.0 (5 pages) (Mar. 26, 2021).
Examination Report corresponding to GB Application No. 2017485.0 (5 pages) (Feb. 17, 2022).
Notification of Transmittal of the International Search Report and the Written Opinion of the International Searching Authority, or the Declaration, in corresponding PCT Application No. PCT/GB2020/052796 (Dec. 8, 2020).

* cited by examiner (A)

(B)

(C)

EJECTOR DEVICE

TECHNICAL FIELD

This invention relates to an ejector device

BACKGROUND

Ejector devices are known for the pumping of fluids, e.g. liquids or gases. Operation of ejector devices is based upon the venturi principle. Velocity of a relatively high pressure fluid (called the "motive" fluid) along a channel provides a suction effect on a relatively low pressure fluid (called the "entrained" or "suction" fluid). The suction fluid is entrained into the main flow through the channel and ejected from the ejector device as a "discharge" fluid. Examples of such ejector devices which use a motive liquid to pressurise a gas may be called a jet pump, a liquid jet compressor or a Venturi pump.

Ejector devices have an advantage over many conventional mechanical pumps in that they can have substantially no moving parts, so may therefore provide a longer service life in many practical applications. Ejectors have been used with a combination of different fluids over the years and can be found in a multitude of industries.

FIG. 1 shows an example of an ejector device described in WO 2012/059773 A2. The ejector device 1 has a motive fluid inlet portion 10 through which a motive fluid can enter the device 1. The motive fluid may for example be pumped by a pump (not shown) into and through the motive fluid inlet or injector portion 10. The velocity of the motive fluid increases as it passes through a conical nozzle portion 40 of the device 1 before being injected through an outlet aperture 44 of the nozzle portion 40 at an apex thereof into an inlet aperture 52 of a diffuser portion 50. The diffuser portion 50 provides a fluid conduit in the form of a Venturi tube, in which, passing from the inlet aperture 52 of the diffuser portion 50 towards an outlet aperture 54 thereof, a diameter of the conduit initially decreases along a first length of the diffuser portion 50 to a diameter less than that of the inlet aperture 52, then remains at that reduced diameter for a short distance, and then along a second length of the diffuser portion 50 the diameter of the conduit increases towards the outlet aperture 54 of the diffuser portion 50.

The outlet aperture 44 of the nozzle portion 40 and the inlet aperture 52 of the diffuser portion 50 are in fluid communication with a suction fluid inlet portion 20 of the device 1. As a flow of motive fluid flows out from the outlet aperture 44 of the nozzle portion 40 and into the diffuser portion 50, the motive and suction fluids are mixed, and this results in a transfer of momentum and thus kinetic energy from the motive fluid to the suction fluid. This is accompanied by a reduction in the flow velocity of the combined fluids and an increase in the pressure of the suction fluid phase. It is to be noted that this is a reverse process to that occurring in the nozzle portion 40 where an increase in motive fluid velocity occurs, thereby reducing a pressure of the motive fluid as it exits the nozzle portion 40 through its outlet aperture 44.

In practical applications of ejectors of the type shown in FIG. 1, the motive fluid may be a liquid or a gas or any other suitable fluid, and the suction fluid may independently also be a liquid or a gas or any other suitable fluid. However, in many particularly useful applications such ejector devices may be used to pressurise and thus pump gaseous fluids, in which case the motive fluid may typically be a liquid phase and the suction fluid may be the gaseous phase to be pumped.

FIG. 1 shows an example of an ejector device with a single channel, where a "channel" is a combination of a nozzle and a diffuser. An ejector device may have multiple channels. An example of a multichannel ejector device is described in WO 2012/059773 A2.

Ejector devices may be deployed for extended periods, such as a period of years, or tens of years. At some point during deployment it may be necessary to change the internal components of an ejector device to adapt to different operating conditions. For example, consider an ejector device is deployed to pump gas or oil from a well. The pressure of the well changes over a period of time. This may require a different nozzle and/or diffuser to allow the ejector to function at required parameters. GB 2 384 027 B describes an ejector with a nozzle and a diffuser which can each, individually, be replaced.

SUMMARY OF THE INVENTION

There is provided an ejector device comprising:

- a housing having a motive fluid inlet to receive motive fluid, a suction fluid inlet to receive suction fluid and a fluid outlet to output the motive fluid and the suction fluid;
- a nozzle and diffuser assembly configured to fit within the housing, wherein the nozzle and diffuser assembly comprises:
  - a nozzle;
  - a diffuser;
  - a connecting structure connecting the nozzle to the diffuser, the connecting structure configured to permit fluid flow between the nozzle and the diffuser, the connecting structure having apertures configured to allow fluid to be drawn into the fluid flow between the nozzle and the diffuser.

The nozzle and diffuser assembly may be called a nozzle-diffuser assembly or a nozzle-diffuser channel.

Optionally, the connecting structure is configured to concentrically align the nozzle and the diffuser about a longitudinal axis of the nozzle and diffuser assembly.

Optionally, the connecting structure is a hollow tubular structure.

Optionally, the connecting structure comprises a plurality of apertures around a perimeter of the connecting structure.

Optionally, the connecting structure comprises at least one of: (i) a collar free of apertures at an upstream end of the connecting structure; (ii) a collar free of apertures at a downstream end of the connecting structure. The collars provide strength to the connecting structure. The collars can help to simplify assembly of an overall nozzle and diffuser assembly. This is particularly useful if the connecting structure is manufactured as a separate element to the nozzle and/or the diffuser, as the collar at the upstream end can be aligned with, and connected to, the nozzle and/or the collar at the downstream end can be aligned with, and connected to, the diffuser.

Optionally, the diffuser has an inlet with an inlet cross sectional area and the plurality of apertures have a combined aperture cross sectional area, and wherein the combined aperture cross sectional area is equal to, or greater than, the inlet cross sectional area.

Optionally, the nozzle and diffuser assembly is removable as a single assembly from one end of the housing.

Optionally, the fluid outlet is located at a downstream end of the housing and the nozzle and diffuser assembly is removable from the downstream end of the housing.

Optionally, the ejector device comprises at least one sealing element to form a fluid-tight seal between the nozzle and diffuser assembly and an interior of the housing.

Optionally, the at least one sealing element is carried by the nozzle and diffuser assembly.

Optionally, the housing is configured to receive a single nozzle and diffuser assembly.

Optionally, a downstream end of the nozzle and diffuser assembly comprises a flange which is configured to fit within a recess at a downstream end of the housing.

Optionally, a downstream end of the housing has a downstream housing end face and wherein, when the nozzle and diffuser assembly is fitted within the housing, a downstream end face of the nozzle and diffuser assembly is configured to substantially align with the downstream housing end face.

Optionally, the housing is configured to receive a plurality of the nozzle and diffuser assemblies.

Optionally, the housing comprises a first supporting wall and a second supporting wall, wherein each of the first supporting wall and the second supporting wall extends radially across an interior of the housing, the first supporting wall and the second supporting wall axially spaced apart along the housing, each of the first supporting wall and the second supporting wall having a plurality of bores to receive the plurality of the nozzle and diffuser assemblies.

The first and second supporting walls may substantially seal a volume between the supporting walls, such that fluid entering the volume between the walls via the suction fluid inlet is prevented from passing beyond the walls unless it is drawn into the diffuser via the apertures in the connecting structure.

Optionally, the housing has an unobstructed interior volume between the first supporting wall and the second supporting wall. The provision of supporting walls, rather than larger supporting structures which extend axially along the housing, has an advantage of reducing an amount of material and therefore weight and cost of the ejector device. Providing an unobstructed interior volume between the supporting walls can help to reduce pressure loss between the suction fluid inlet and the diffusers. Providing an unobstructed interior volume between the supporting walls can also allow easier cleaning of the interior volume of the housing.

Optionally, the nozzle and diffuser assemblies are removable from a downstream end of the housing.

Optionally, the ejector device comprises a plate which is configured to fit across a respective downstream end of the plurality of nozzle and diffuser assemblies.

Optionally, a downstream end of the housing has a downstream housing end face and wherein, when the plate is fitted to the device, a downstream end face of the plate is configured to substantially align with the downstream housing end face.

Optionally, the housing comprises a first housing part and a second housing part, the first housing part configured to connect with the second housing part at a joint to form a fluid-tight housing, wherein the second supporting wall is located at, or upstream of, the joint between the first housing part and the second housing part.

The suction fluid inlet may be axially aligned with apertures of the connecting structure (or from apertures of the plurality of connecting structures) such that there is a direct radial path between the suction fluid inlet and the apertures.

Optionally, the suction fluid inlet is axially offset from apertures of the connecting structure (or from apertures of the plurality of connecting structures where the housing is configured to receive a plurality of the nozzle and diffuser assemblies). This can help improve uniformity of distribution of fluid around the connecting structure or structures. This in turn can improve an efficiency of the ejector device.

A centreline of the suction fluid inlet may be axially offset from apertures of the connecting structure by at least or substantially 0.5 diameters of the suction fluid inlet, or by at least or substantially one diameter of the suction fluid inlet, or by at least or substantially two diameters of the suction fluid inlet, or by at least or substantially three diameters of the suction fluid inlet.

An aspect provides a method of maintaining an ejector device comprising:

accessing an interior of a housing of the ejector device, the housing having a motive fluid inlet to receive motive fluid, a suction fluid inlet to receive suction fluid and a fluid outlet to output the motive fluid and the suction fluid; and removing a nozzle and diffuser assembly from the housing as a single combined assembly, the nozzle and diffuser assembly comprising: a nozzle; a diffuser; a connecting structure connecting the nozzle to the diffuser, the connecting structure configured to permit fluid flow between the nozzle and the diffuser, the connecting structure having apertures configured to allow fluid to be drawn into the fluid flow between the nozzle and the diffuser.

Optionally, the single end of the housing is at, or near, a downstream end of the housing.

Optionally, the method comprises one of:

re-inserting the nozzle and diffuser assembly into the housing as a single combined assembly;

inserting a different nozzle and diffuser assembly into the housing as a single combined assembly.

An advantage of this arrangement is that the nozzle can accurately aligned with respect to the diffuser. Alignment of the nozzle with respect to the diffuser is determined during manufacture of the nozzle and diffuser assembly. The term "alignment" refers to the nozzle and the diffuser being aligned concentrically about the same longitudinal axis. This contrasts with prior art ejectors where the nozzle and the diffuser and independently supported by different parts of the ejector, or ejector housing. This means that in prior art systems alignment of the nozzle with respect to the diffuser is determined by features of the housing (e.g. shoulders) in which the nozzle and the diffuser are housed or supported. These features can become deformed or damaged. This can also avoid the need to perform alignment checks on the ejector after installing the nozzle and diffuser assembly.

An advantage of this arrangement is that a nozzle and diffuser channel of an ejector system can be inspected, maintained or replaced in a reduced time. This reduces time that the ejector is out of operation, and reduces cost of maintenance.

An advantage of this arrangement is that a nozzle and diffuser channel of an ejector system can be inspected, maintained or replaced by removing a piece of the pipework at a single end of the ejector. For example, by removing pipework at just the downstream end of the ejector. This reduces the number of connections that need to be broken, remade and re-checked for fidelity. During this period the housing remains in situ.

An advantage of this arrangement is that only one end of the ejector device needs to be provided with features to allow access to the interior of the housing. For example, only one end of the ejector device requires a flanged-connection. Advantageously, only a downstream end of the ejector device is provided with a connection to allow access.

Optionally, the connecting structure cage is configured such that it has minimal pressure drop on the path to the diffuser, whilst providing a strong and rigid connection that maintains the concentricity of the nozzle and the diffuser.

In implementing some embodiments or examples of the invention, the components of the injector portion may be designed with various shapes, configurations and/or orientations which may achieve a particular desirable flow behaviour of generating certain defined components of flow of the motive fluid, as will be discussed further below.

Other objects and advantages of the invention or embodiments thereof may be apparent from the further definitions and descriptions which follow below of embodiments of the invention and particular features thereof.

Within the scope of this application it is envisaged and explicitly intended that the various aspects, embodiments, features, examples and alternatives, and in particular any of the variously defined and described individual features thereof, set out in any of the preceding paragraphs, in the claims and/or in any part of the following description and/or accompanying drawings, may be taken and implemented independently or in any combination. For example, features described in connection with one particular embodiment or aspect are to be considered as applicable to and utilisable in all embodiments of all aspects, unless expressly stated otherwise or such features are, in such combinations, incompatible.

BRIEF DESCRIPTION OF THE DRAWINGS

Embodiments of the present invention in its various aspects will now be described, by way of example only, with reference to the accompanying drawings, in which.

DETAILED DESCRIPTION OF EMBODIMENTS

Figure 1:
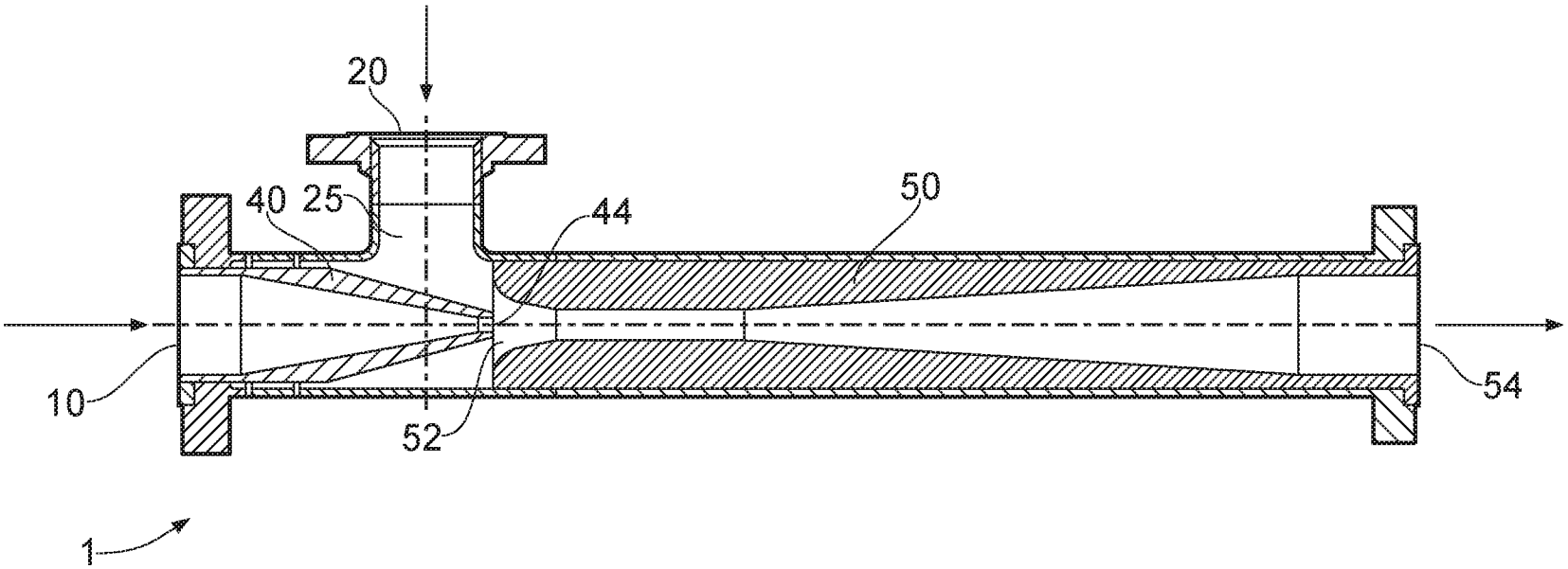
FIG. 1 (Prior Art)
FIG. 1 shows a cross sectional view of a known ejector device.

FIG. 2A-2C show an example of a single-channel ejector device 100. The ejector device 100 comprises a housing 110 and a nozzle-diffuser assembly 150. FIG. 2A shows the housing 110 of the ejector device. FIG. 2B shows the nozzle-diffuser assembly 150. FIG. 2C shows the ejector device 100 in assembled form, with the nozzle-diffuser assembly 150 of FIG. 2B fitted within the housing 110 of FIG. 2A.

The housing 110 comprises a first inlet 111, a second inlet 112 and an outlet 113. The first inlet 111 will be called a motive inlet or a high pressure inlet. The first inlet 111 is configured to receive a high pressure fluid. The first inlet 111 is located at a first, upstream, end of the housing 110. The second inlet 112 will be called a suction inlet or a low pressure inlet. The second inlet 112 is configured to receive a fluid which is typically at a lower pressure than the pressure received at the first inlet 111. The second inlet 112 is located part-way along the housing 110. The outlet 113 is configured to output a combination of the fluids received via the first inlet 111 and the second inlet 112. The outlet 113 is located at a second, downstream, end of the housing 110. The housing 110 is configured to retain the pressures of the fluids the nozzle-diffuser channel is designed to perform over.

Figure 2:
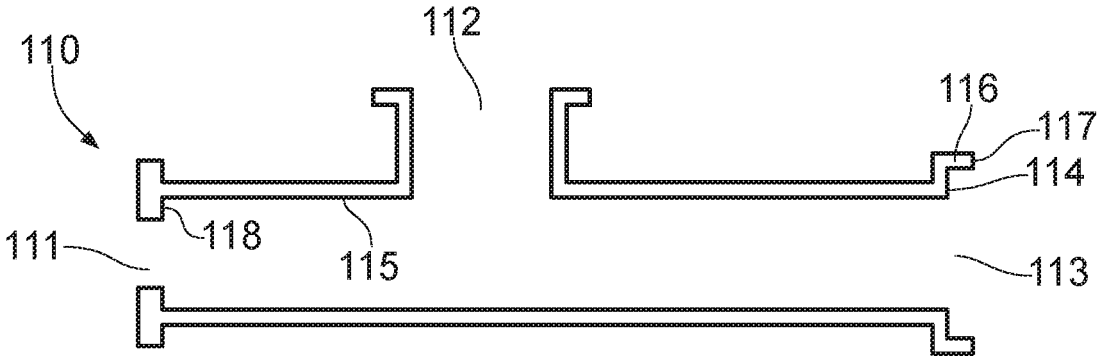
FIG. 2A shows a housing for a single-channel ejector device.
FIG. 2B shows a nozzle and diffuser assembly for fitting within the housing of FIG. 2A.
FIG. 2C shows the nozzle and diffuser assembly of FIG. 2B fitted within the housing of FIG. 2A.
Figure 2:
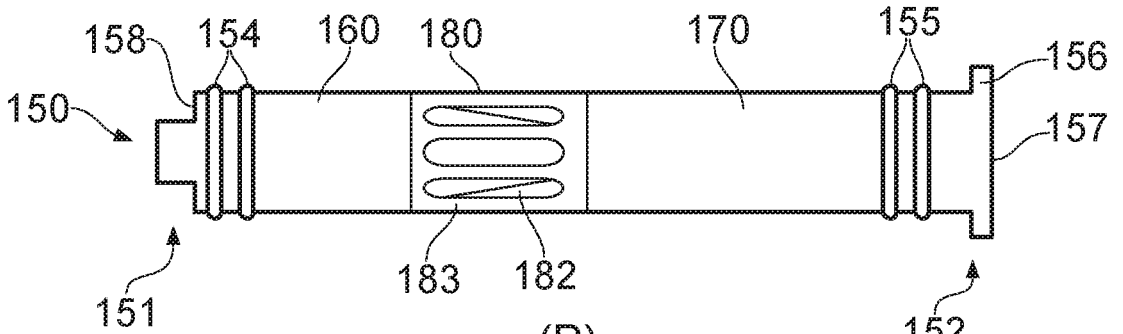
Figure 2:
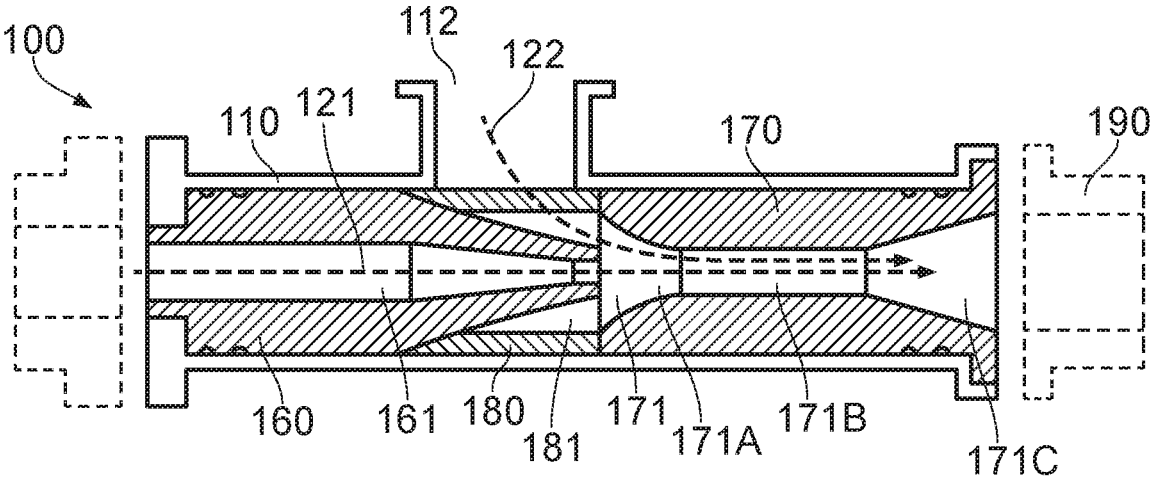

The nozzle-diffuser assembly 150 comprises a nozzle 160 and a diffuser 170 which are connected together by a connecting structure 180. The connection is such that the nozzle-diffuser assembly 150 can be inserted, as a single combined assembly, into the housing 110 via a single end of the housing 110. The nozzle-diffuser assembly 150 can also be removed, as a single combined assembly, from the housing 110 via the single end of the housing 110. In FIG. 2 the nozzle-diffuser assembly 150 can be inserted via the outlet 113 end of the housing 110. The outlet 113 is at a lower pressure than the first inlet 111 and therefore it is easier to provide access at the outlet 113. For example, the dimensions of flanges, and the fittings to secure the flanges together, at the outlet 113 are smaller than would be required at the first inlet 111.

FIG. 2C shows a cross section through the housing 110 and the nozzle-diffuser assembly 150. An internal wall 115 of the housing 110 defines a bore. Typically the bore has a circular cross-sectional shape. The nozzle-diffuser assembly 150 has an outer diameter which is slightly smaller than a diameter of the internal wall 115. The internal wall 115 of the housing 110 may have a substantially constant diameter along its length (i.e. the internal wall is cylindrical). Alternatively, the internal wall 115 of the housing 110 may have a smaller diameter nearer the upstream end (e.g. the internal wall 115 has a tapered shape or the internal wall 115 has a collar of smaller diameter). This can allow the nozzle-diffuser assembly 150 to move into position with reduced friction between the outer surface of the nozzle-diffuser assembly 150 and the internal wall 115. This can help to reduce wear or damage to any seals, such as O-rings 154, 155. The nozzle-diffuser assembly 150 carries O-rings 154, 155 to form a seal against the internal wall 115. In this example the O-rings 154, 155 are carried by the nozzle-diffuser assembly 150. This has an advantage of allowing the O-rings to be inspected and/or replaced when the nozzle-diffuser assembly 150 is removed from the housing 110. In another example the O-rings 154, 155 may be located within the housing 110.

The nozzle 160 has a nozzle channel 161. The nozzle channel 161 is aligned with a longitudinal axis of the nozzle-diffuser assembly 150. A width/diameter of the nozzle channel 161 reduces towards the downstream end (tip) of the nozzle 160. This shape of the nozzle channel 161 causes fluid to increase in velocity as it passes towards the downstream end of the nozzle. The increase in velocity is accompanied by a reduction in pressure. The outer surface of the nozzle 160 also reduces in width/diameter towards the downstream end of the nozzle. This provides a surface over which suction fluid 122 can flow.

The diffuser 170 has a diffuser channel 171. The diffuser channel 171 varies in width/diameter between an upstream end and a downstream end of the diffuser 170. In FIG. 2C the diffuser channel 171 comprises: a first portion 171A in which the diffuser channel 171 reduces in width/diameter (i.e. a converging portion); a second portion 171B in which the diffuser channel 171 has a substantially constant width/diameter; and a third portion 171C in which the diffuser channel 171 increases in width/diameter (i.e. a diverging portion). Other arrangements are possible. For example, the relative axial lengths of the first, second and third portions 171A, 171B, 171C can be different to the diffuser shown here. The narrowest diameter of the diffuser channel 171 may be different to the diffuser shown here.

The connecting structure 180 connects the nozzle 160 to the diffuser 170. In FIG. 2 the connecting structure 180 is a hollow tubular structure. The connecting structure 180 has a plurality of apertures, or orifices 182, configured to allow fluid to pass into the interior of the connecting structure 180. The connecting structure 180 resembles a cage. In FIG. 2B the apertures 182 are distributed around the connecting structure. Narrow struts 183 are provided between adjacent apertures 182. The tubular structure 180 connects to the nozzle 160 in the region where the outer surface of the nozzle 160 begins to taper. The tubular structure 180 connects to the diffuser 170 at the upstream end of the diffuser. The outer diameter of the connecting structure 180 is equal, or substantially equal, to the outer diameter of the nozzle 160 and the diffuser 170. In this way, the outer diameter of the nozzle-diffuser assembly is substantially equal along its length. The connecting structure 180 axially spaces the outer surface of the nozzle 160 from the diffuser channel 171. In the example shown in FIG. 2C the downstream end of the nozzle 160 is substantially aligned with the upstream end of the diffuser 170, but other arrangements are possible. The connecting structure 180 defines a region 181 between the connecting structure 180 and the outer surface of the nozzle 160.

In FIG. 2 the hollow tubular structure 180 has a cylindrical wall with apertures 182 in the wall. The hollow tubular structure 180 has a cylindrical collar 185 at an upstream end and a cylindrical collar 186 at a downstream end. The collars 185, 186 are regions which are free of apertures 182, i.e. regions where there are no apertures 182. The collars 185, 186 increase strength of the connecting structure 180. The collars 185, 186 can also provide regions for connecting the connecting structure 180 to the nozzle 160 and diffuser 170. For example, the collar can provide a surface to weld to the nozzle 160. The collar 185 can surround part of the nozzle 160 when the connecting structure is assembled to the nozzle. The connection between the connecting structure 180 and the nozzle 160 can be achieved by pressing together with a press or interference fit, welding or some other form of connection, such as a screwed fit. During assembly, collar region 185 at the upstream end of the tubular structure 180 can be aligned with and connected to a cylindrical downstream end of the nozzle 160. During assembly, collar region 186 at the downstream end of the tubular structure 180 can be aligned with and connected to a cylindrical upstream end of the diffuser 170. The connection between the connecting structure 180 and the diffuser 170 can be achieved by pressing together with a press or interference fit, welding or some other form of connection, such as a screwed fit. The connecting structure can be manufactured as a separate element to the nozzle 160 and/or the diffuser 170 and then assembled. The collar(s) allow the connecting structure to be aligned with, and connected to, the nozzle 160 and/or the diffuser 170 during assembly. The axial length of each of the collars 185, 186 can be different to what is shown in FIG. 2. For example, the nozzle-diffuser assembly 550 shown in FIG. 9 has longer collars 585, 586.

FIG. 2C shows, in simple terms, fluid flows in the ejector device. It will be understood that the precise path of the fluid flows are more complex than it is possible to show here. There is a flow 121 of motive fluid from the first inlet 111, through the nozzle channel 161 and into the diffuser channel 171. The shape of the nozzle channel 161 causes a jet of motive fluid to flow from the downstream tip of the nozzle 160. This creates a low pressure region near the tip of the nozzle 160. The low pressure region serves to entrain suction fluid via the second inlet 112. There is a flow of suction fluid from the second inlet 112 which passes through apertures 182 of the connecting structure 180, into the region 181 between the connecting structure 180 and the outer surface of the nozzle 160. Suction fluid is guided by the outer surface of the nozzle 160 towards the low pressure region at the inlet of the diffuser channel 171. The motive fluid and suction fluid combine in the diffuser 170. The shape of the diffuser channel 171 serves to combine the fluid flows. For the suction fluid, the diffuser channel 171 is narrowing and therefore causes the suction fluid to speed up. For the motive fluid, the diffuser channel 171 is wider than the tip of the nozzle 160 and therefore causes the motive fluid to slow down. A combined fluid flow exits the outlet 113 of the ejector device. A more detailed description of the operation of a nozzle and a diffuser of an ejector device is available in, for example, GB 2 384 027 A.

Typically, the ejector 100 is fitted within an overall fluid flow system of pipes or conduits. Each end of the ejector device 100 has a suitable connector for connecting to a fluid conduit or other fitting or device. One type of connector is a flange. A pair of fittings are connected together by aligning their respective flanges together and securing the flanges together by bolts or other fixings. Other types of connector are possible, suitable for the mechanical design conditions of system the device is connected to.

In FIG. 2 the downstream (outlet end) of the housing 110 has a shoulder 114. The shoulder 114 is a radially-extending surface, orthogonal to the longitudinal axis of the housing 110. The housing continues downstream of the shoulder 114, with a collar 116 having a radial outer surface 117 on the downstream end face. The collar 116 and shoulder 114 together define a recess for receiving a downstream end of the nozzle-diffuser assembly 150. The nozzle-diffuser assembly 150 has a flange 156 which is configured to locate against the shoulder 114 of the housing 110. FIG. 2C shows the flange 156 of the nozzle-diffuser assembly 150 located against the shoulder 114. The flange 156 has a diameter which is less than the internal diameter of the collar 116. The flange 156 has an axial length which is substantially equal to the axial distance between the shoulder 114 and outer surface 117 of the housing. This allows an outer surface 157 of the flange 156 to lie in the same plane as the radial surface 117 of the housing. A flange (or other fitting) can be pressed against the flange 156 and the outer surface 117 of the housing. This provides a surface to connect against, and also securely retains the nozzle-diffuser assembly 150 within the housing 110.

The arrangement described above provides an end stop for axial movement of the nozzle-diffuser assembly 150. The nozzle-diffuser assembly 150 can be inserted into the housing 110 until the flange 156 rests against the shoulder 114 of the housing 110.

In FIG. 2B, the upstream end of the nozzle-diffuser assembly 150 has an annular radial surface 158. An upstream end of the housing 110 has a radial end surface 118. It will be understood that differently shaped surfaces could be provided at the upstream end, such as inclined surfaces.

In the example shown in FIG. 2B axial movement of the nozzle-diffuser assembly 150 is constrained at the upstream end (by radial surface 118) and at the downstream end (by shoulder 114). In other examples, the nozzle-diffuser assembly 150 may be configured to allow for thermal expansion at the upstream end. For example, there can be an axial gap between the upstream end of the nozzle-diffuser assembly 150 and a wall of the housing 110. This can have an advantage of allowing for thermal expansion.

Removal of the nozzle-diffuser assembly 150 will now be described. In FIG. 2C a fitting 190 is connected to the downstream end of the housing 110. Firstly, the fitting 190 is removed from the ejector, such as disconnecting a flange connected to the flange at the downstream end of the housing 110. This provides access to the interior of the housing 110. The nozzle-diffuser assembly 150 can then be withdrawn, as a single assembly, from the interior of the housing. Once the nozzle-diffuser assembly 150 has been withdrawn from the housing, it can be inspected (e.g. for routine maintenance, cleaning etc.) and re-inserted into the housing. Alternatively, the nozzle-diffuser assembly 150 which has been withdrawn from the housing may be replaced with a different nozzle-diffuser assembly 150. The different nozzle-diffuser assembly 150 may have one or more of: a different nozzle 160 (e.g. a differently shaped or dimensioned nozzle channel 161, a different cross-sectional outlet size at the nozzle tip, a different cross-sectional outlet size at the nozzle inlet, a differently shaped or dimensioned exterior of the nozzle); a different diffuser 170 (e.g. differently shaped or dimensioned diffuser channel 161; different relative dimensions between the portions 171A, 171B, 171C of the diffuser channel); a different spacing between the nozzle and the diffuser. After inserting a nozzle-diffuser assembly 150 into the housing, the fitting is reconnected to the flange at the downstream end of the housing.

The nozzle-diffuser assembly 150 may be provided with one or more features to ease withdrawal from the housing. Options include: a lip or ridge that can be gripped with a tool; threaded bores that allow a tool to connect to, and withdraw, the nozzle-diffuser assembly 150.

Figure 3:
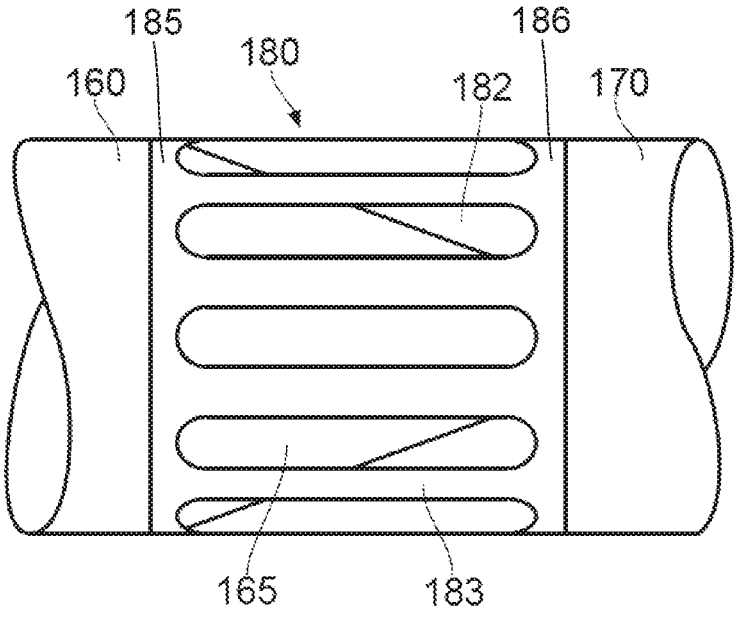
FIG. 3 shows a connecting structure of FIG. 2B in more detail.

FIG. 3 shows the connecting structure 180 in more detail. The outer surface 165 of the nozzle 160 is visible inside the connecting structure 180. In this example the apertures 182 have a generally racetrack shape. The apertures 182 are configured to minimise pressure drop of the fluid from the suction inlet 112. This can be achieved by providing a total cross section of all the apertures 182 equal to, or greater than, the cross sectional area of the inlet (i.e. upstream end) of the diffuser 170. As an example, the number of apertures per connecting structure 180 may be between six and eight, or between six and ten. Other numbers of apertures are possible. The struts 183 provide structural support and maintain structural integrity. For example, the struts 183 are configured to maintain alignment of the nozzle 160 with respect to the diffuser 170 during use. The struts 183 are configured to maintain alignment of the nozzle 160 with respect to the diffuser 170 (i.e. withstand mechanical deformation) during the forces encountered while the nozzle-diffuser assembly 150 is inserted within and/or removed from the housing.

An upstream end of the connecting structure 180 is connected the nozzle 160. The connection can be achieved by pressing together with a press or interference fit, welding or some other form of connection, such as a screwed fit. Another type of connection may be used. A combination of connection types may be used. A downstream end of the connecting structure 180 is connected to the diffuser 170. The connection can be achieved by pressing together with a press or interference fit, welding or some other form of connection, such as a screwed fit. Another type of connection may be used. A combination of connection types may be used.

There are various options for manufacturing and assembling the nozzle-diffuser assembly 150. One option is to separately form the nozzle 160, the diffuser 170 and the connecting structure 180 and then to assemble these items together. Another option is form two of these as a single item and then assemble to the remaining item (e.g. form the diffuser and the connecting structure as a single item and assemble to the nozzle). Another option is to form the nozzle 160, the diffuser 170 and the connecting structure 180 as a single integrated item.

Figure 4:
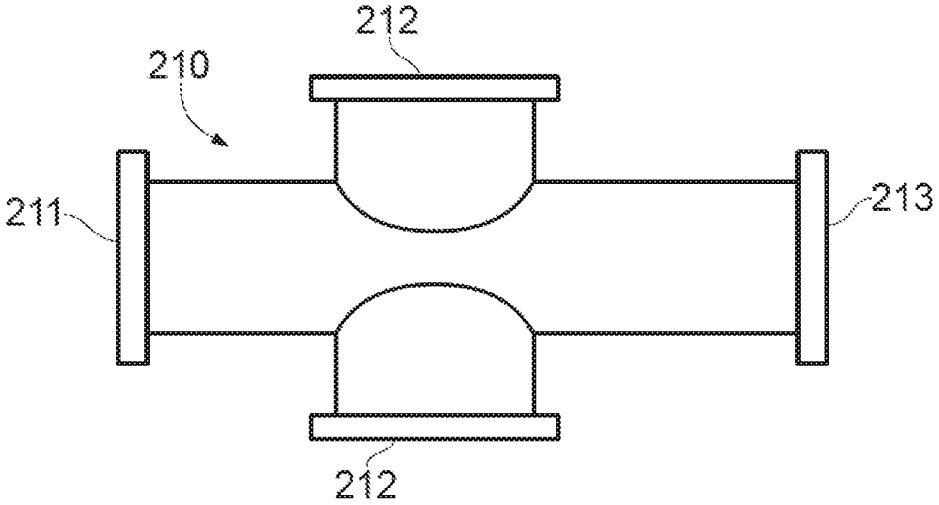
FIG. 4 shows an alternative inlet arrangement for the housing.
Figure 5:
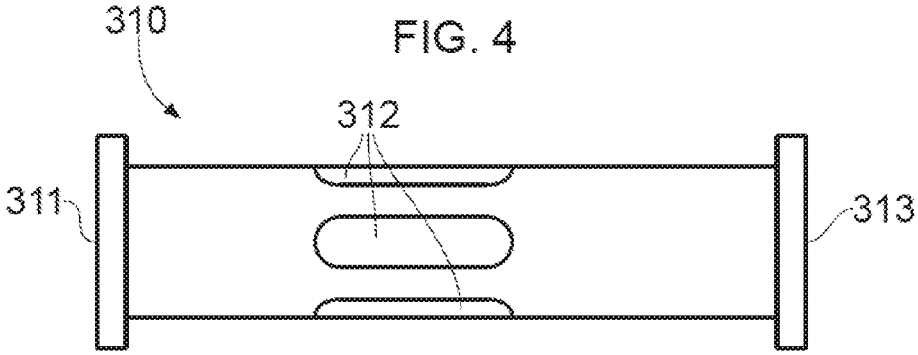
FIG. 5 shows another alternative inlet arrangement for the housing.

In FIG. 2 the housing 110 has a single suction inlet 112. FIG. 4 and FIG. 5 show two alternative arrangements. In FIG. 4 the housing 210 has a first (motive) inlet 211, an outlet 213 and a plurality of second (suction) inlets 212. Each suction inlet 212 is defined by a discrete conduit extending outwardly from the housing 210. The total number of suction inlets may be more than two. In FIG. 5 the housing 310 has a first (motive) inlet 311, an outlet 313 and a plurality of second (suction) inlets 312. The suction inlets 312 are provided as apertures in the wall of the housing 310. A distribution chamber (not shown) may surround the plurality of suction inlets 312 and connect to a main suction inlet.

Multi-Channel Device

Figure 6:
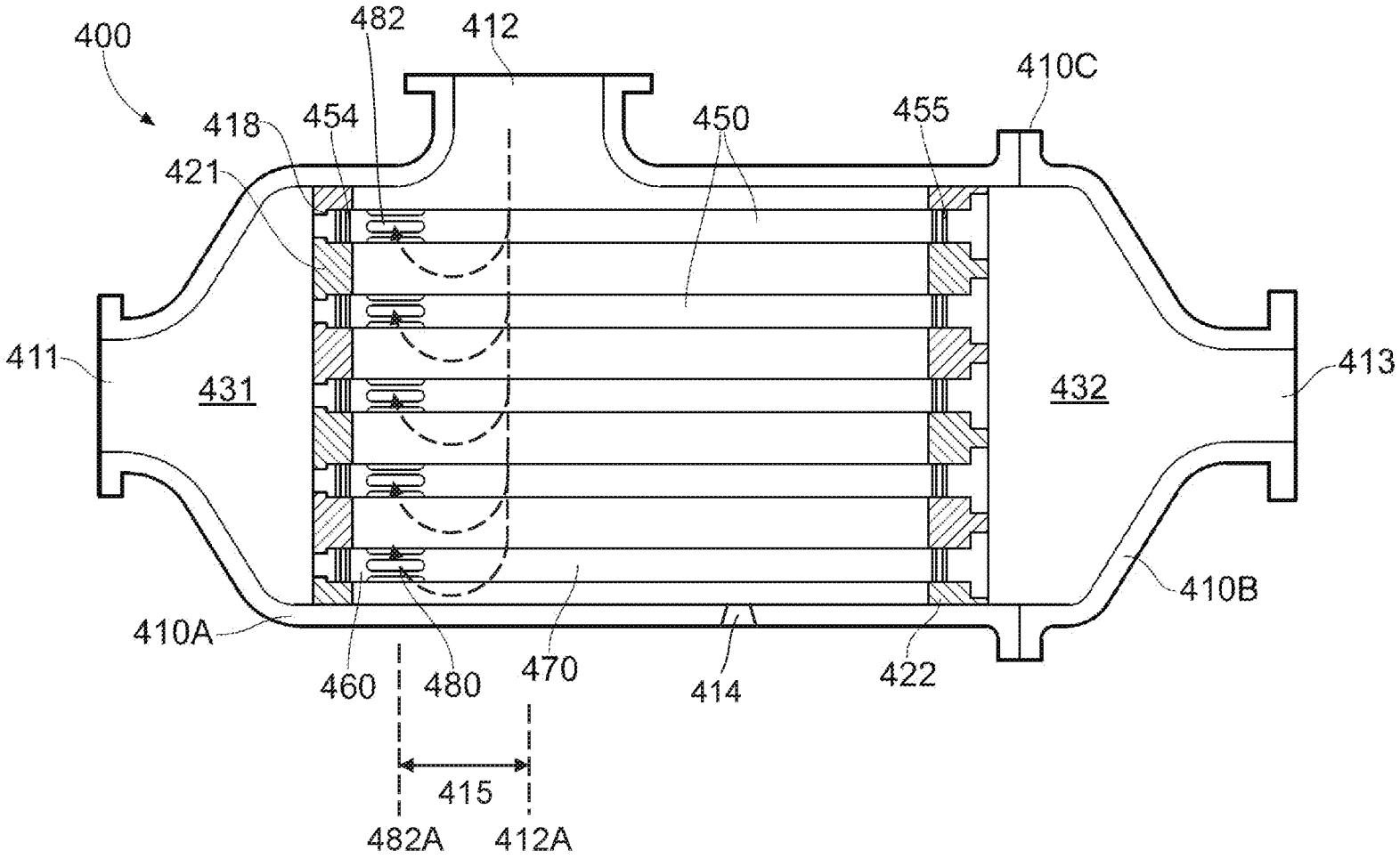
FIG. 6 shows a multi-channel ejector device.

FIG. 6 shows an example of a multi-channel ejector device 400. The ejector device 400 comprises a housing 410 and a plurality of nozzle-diffuser assemblies 450. FIG. 6 shows the plurality of nozzle-diffuser assemblies 450 fitted within the housing 410.

The housing 410 is formed as two housing parts: 410A, 410B. Housing parts 410A, 410B are connected together at a joint or connection 410C. Housing part 410B may be removed from housing part 410A to allow access to the nozzle-diffuser assemblies 450. The connection between the housing parts 410A, 410B may be implemented as a pair of flanges and fixings, or by some other type of connection which allows the housing parts to be removed from one another. The joint between the housing parts 410A, 410B is capable of forming a fluid-tight seal and may comprise one or more sealing elements. The joint between the housing parts 410A, 410B is provided at the downstream end of the housing.

The housing 410 is formed as two housing parts (which can be referred to as first and second housing parts or first and second housing members): 410A, 410B. Housing parts 410A, 410B are connected together at a joint or connection 410C. Housing part 410B may be removed from housing part 410A to allow access to the nozzle-diffuser assemblies 450. The connection between the housing parts 410A, 410B may be implemented as a pair of flanges and fixings, or by some other type of connection which allows the housing parts to be removed from one another. The joint between the housing parts 410A, 410B is capable of forming a fluid-tight seal and may comprise one or more sealing elements. The joint between the housing parts 410A, 410B is provided at the downstream end of the housing.

The plurality of nozzle-diffuser assemblies 450 are supported within the housing by a pair of supporting walls 421, 422. A first supporting wall 421 is provided near the upstream end of the first housing part 410A and a second supporting wall 422 is provided near the downstream end of the first housing part 410A. Each of the supporting walls 421, 422 has a plurality of bores for receiving the nozzle-diffuser assemblies 450. A nozzle-diffuser assembly 450 is supported by a bore in the supporting wall 421 and by a bore in the supporting wall 422. The bores in the supporting wall 421 are shaped to form an end stop. In the example of FIG. 6 the wall 421 has a radial end surface or collar 418. The surface 418 serves as an end stop to limit axial movement of the nozzle-diffuser assembly 450 when it is inserted within the housing 410. The upstream end of the nozzle-diffuser assembly 450 has an annular radial surface to fit against the end stop. It will be understood that this end stop function could be achieved with differently shaped surface, such as an inclined surface.

In the example of FIG. 6 the housing 410 has an unobstructed interior volume between the first supporting wall 421 and the second supporting wall 422. That is, there is no other supporting structure for the nozzle-diffuser assemblies 450. Only the nozzle-diffuser assemblies 450 are positioned within the volume between the supporting walls 421, 422. The provision of supporting walls 421, 422, rather than larger supporting structures which extend axially along the housing, has an advantage of reducing an amount of material and therefore weight and cost of the ejector device 400. As the nozzle 460 and diffuser 470 of each nozzle-diffuser assembly 450 are connected into one integrated assembly, there is no need to provide a longer axial support for the nozzle or the diffuser. Providing an unobstructed interior volume between the supporting walls 421, 422 can help to reduce pressure loss between the suction inlet 412 and the diffusers 470.

The housing 410 can be provided with a drain port 414. The drain port 414 is closed by a closure device such as a plug, stopper or tap. The drain port 414 can be opened during maintenance or servicing to allow the interior volume of the housing 410 to be drained and cleaned. Providing an unobstructed interior volume between the supporting walls 421, 422 makes it easier to clean the interior volume. By contrast, if each diffuser were supported in a longer axial slot it would be more difficult to clean the interior volume.

The first housing part 410A increases in width/diameter downstream of the first inlet 411. This provides a diverging chamber 431 to distribute the incoming fluid to the respective upstream ends of the plurality of nozzle-diffuser assemblies 450. The central portion of the housing 410 has a substantially constant width/diameter. The second housing part 410B decreases in width/diameter downstream of the connection 410C. This provides a converging chamber 432 which helps to converge the flows from the plurality of nozzle-diffuser assemblies 450.

Each of the plurality of nozzle-diffuser assemblies 450 is similar to the nozzle-diffuser assembly 150. Each nozzle-diffuser assembly 450 comprises a nozzle 460 and a diffuser 470 which are connected together by a connecting structure 480. Each of the nozzle-diffuser assemblies 450 can be inserted, as a single combined assembly, into the housing part 410A via the downstream end of the housing part 410A.

Each of the nozzle-diffuser assemblies 450 has an outer diameter which is slightly smaller than a diameter of the bore in the supporting walls 421, 422. This allows the nozzle-diffuser assembly 450 to slide into position. The nozzle-diffuser assembly 450 carries O-rings to form a seal against the supporting walls 421, 422.

The connecting structure 480 connects the nozzle 460 to the diffuser 470. The connecting structure 480 has a plurality of apertures configured to allow fluid to pass into the interior of the connecting structure 480. The connecting structure 480 resembles a cage. In use, fluid flows via the suction 412 into the region around the plurality of nozzle-diffuser assemblies 450. Fluid from the suction inlet 412 is distributed between the plurality of nozzle-diffuser assemblies 450 and enters the connecting structures of the nozzle-diffuser assemblies 450. The fluid paths shown in FIG. 6 are illustrative. Within the nozzle-diffuser assemblies 450, the process is the same as described above for the nozzle-diffuser assembly 150 and will not be described further. Combined fluid (i.e. motive fluid and suction fluid) is output from the downstream ends of the nozzle-diffuser assemblies 450 and converged by the housing before flowing out of the outlet 413.

In FIG. 6 it will be understood that, for each of the individual nozzle-diffuser assemblies 450, the alignment of the nozzle 460 with respect to the diffuser 470 is determined by the assembly 450 itself. This contrasts with conventional multi-channel ejector devices where the alignment of the nozzle with respect to the diffuser is determined by supports within the housing.

In FIG. 6 the connecting structures 480 are axially offset along the housing from the suction inlet 412. In this example a centreline 412A of the suction inlet 412 is offset from a centreline 482A of the apertures 482 by an axial distance 415. This can provide an advantage of maximising the length of the diffuser 470 for a given length of housing. It can also help to allow the fluid arriving via inlet 412 to settle to some extent before entering apertures 482 of one of the nozzle-diffuser assemblies 450. The unobstructed interior volume between the supporting walls 421, 422 provides flexibility with nozzle-diffuser assemblies. There can be a range of different types of nozzle-diffuser assemblies 450 which are each suited to particular applications. For example, some applications may require a longer diffuser 470 section. The different types of nozzle-diffuser assemblies 450 can have apertures 482 positioned at different axial positions, while still being positioned within the unobstructed interior volume.

In FIG. 6 a downstream end of each of the individual nozzle-diffuser assemblies 450 is provided with a flange. The flange locates within a complementary recess in the supporting wall 422. A nozzle-diffuser assembly 450 can be retained within the housing by fixings passing through the flange into the supporting wall 422.

Removal of the nozzle-diffuser assemblies 450 will now be described. The second housing part 410B is disconnected from the first housing part 410A at joint 410C at the downstream end of the housing 410. This provides clear access to the interior of the housing, and access to the downstream ends of the plurality of nozzle-diffuser assemblies 450. An individual nozzle-diffuser assembly 450 can be removed from the housing by removing fixings securing that individual nozzle-diffuser assembly 450. The selected nozzle-diffuser assembly 450 can then be withdrawn, as a single assembly, from the interior of the housing. Once the nozzle-diffuser assembly 450 has been withdrawn from the housing, it can be inspected (e.g. for routine maintenance, cleaning etc.) and re-inserted into the housing. Alternatively, the nozzle-diffuser assembly 450 which has been withdrawn from the housing may be replaced with a different nozzle-diffuser assembly 450. The nozzle-diffuser assembly 450 is secured by replacing the fixings. Other nozzle-diffuser assemblies 450 may be operated upon in the same way. Finally, the second housing part 410B is reconnected to the first housing part 410A at joint 410C.

Similar to the single channel case of FIG. 2, there are some alternatives to how the nozzle-diffuser assemblies 450 are supported within the housing 410. In the example shown in FIG. 6 axial movement of the nozzle-diffuser assembly 450 is constrained at the upstream end (by a radial surface of collar 418) and at the downstream end (by a shoulder in the supporting wall 422). In other examples, the nozzle-diffuser assemblies 450 may be configured to allow for thermal expansion at the upstream end. For example, there can be an axial gap between the upstream end of the nozzle-diffuser assemblies 450 and a constraining surface in supporting wall 421. This can have an advantage of allowing for thermal expansion.

Figure 7:
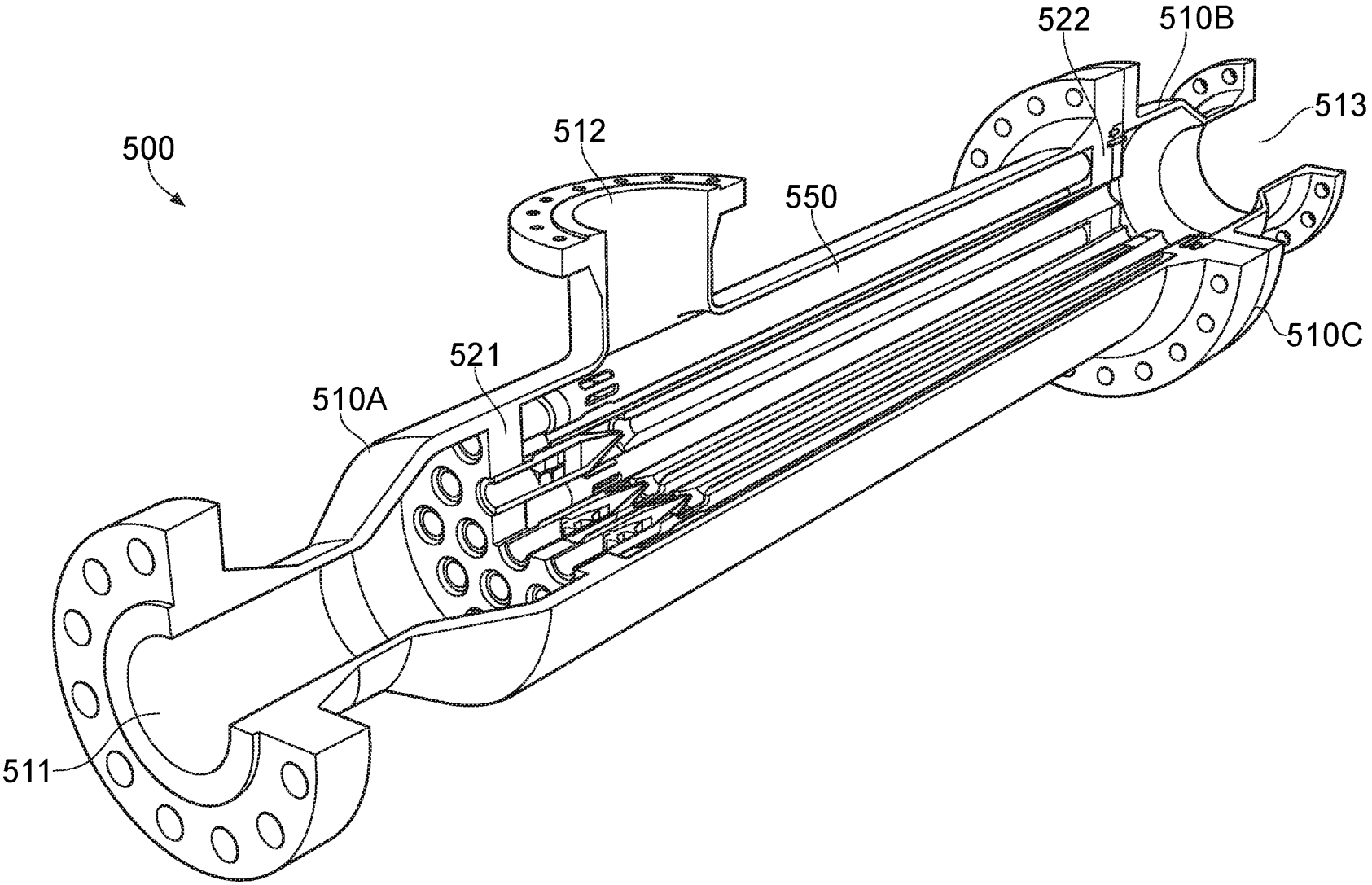
FIG. 7 shows another multi-channel ejector device.
Figure 8:
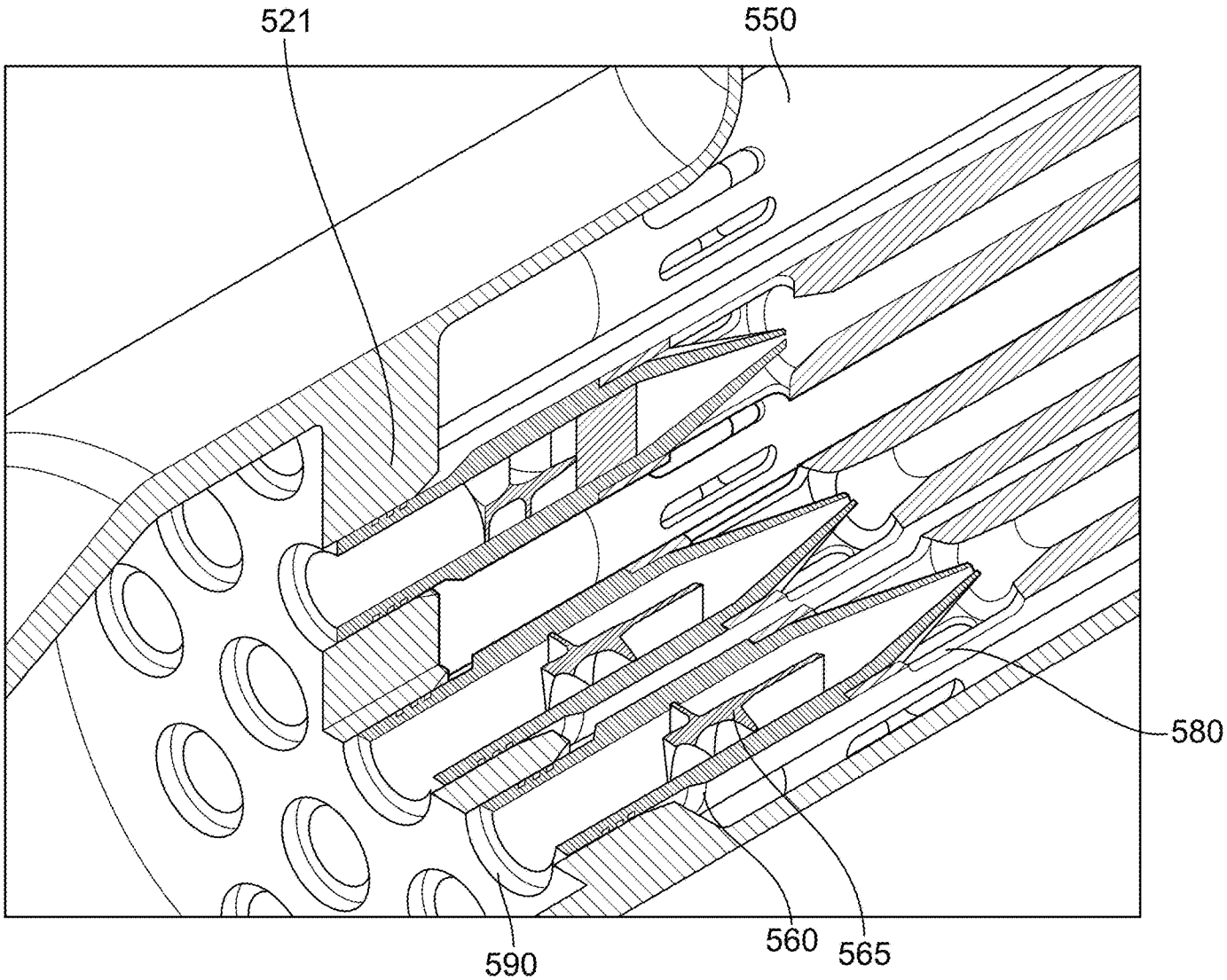
FIG. 8 shows the multi-channel ejector device of FIG. 7 in more detail.

FIGS. 7-10 show another example of a multi-channel ejector device 500. The multi-channel ejector device 500 is similar to the multi-channel ejector device 400. The multi-channel ejector device 500 has a larger number of nozzle-diffuser assemblies 550 and shows an example of a different configuration at the upstream ends and the downstream ends of the nozzle-diffuser assemblies 550. The ejector device 500 comprises a housing 510 and a plurality of nozzle-diffuser assemblies 550. FIG. 7 shows the plurality of nozzle-diffuser assemblies 550 fitted within the housing 510. FIG. 8 shows a more detailed view of the plurality of nozzle-diffuser assemblies 550 fitted within the housing 510, with a cut-away view of some of the nozzle-diffuser assemblies 550.

The housing 510 is formed as two housing parts (which can be referred to as first and second housing parts or first and second housing members): 510A, 510B. Housing parts 510A, 510B are connected together at a connection 510C. Housing part 510B may be removed from housing part 510B to allow access to the nozzle-diffuser assemblies 550. The housing 510 comprises a first inlet 511, a second inlet 512 and an outlet 513. The first (motive) inlet 511 is configured to receive a high pressure fluid. The first inlet 511 is located at a first, upstream, end of the housing 510. The second (suction) inlet 512 is configured to receive a fluid which is typically at a lower pressure than the pressure received at the first inlet 511. The second inlet 512 is located part-way along the housing 510. The outlet 513 is configured to output a combination of the fluids received via the first inlet 511 and the second inlet 512. The outlet 513 is located at a second, downstream, end of the housing 110.

The plurality of nozzle-diffuser assemblies 550 are supported within the housing by a pair of supporting walls 521, 522. A first supporting wall 521 is provided near the upstream end of the first housing part 510A and a second supporting wall 522 is provided at the downstream end of the first housing part 510A. Each of the supporting walls 521, 522 has a plurality of bores for receiving the nozzle-diffuser assemblies 550. A nozzle-diffuser assembly 550 is supported by a bore in the first supporting wall 521 and by a bore in the second supporting wall 522. The bores in the first supporting wall 521 may be tapered on their downstream side. This is shown in the detailed view of FIG. 8. The tapering can help to make it easier to insert the nozzle-diffuser assembly 550 into the supporting wall 521. The upstream end of a nozzle-diffuser assembly 550 first locates within the wider portion of the tapered bore before being guided into the narrower portion of the bore.

Figure 9:
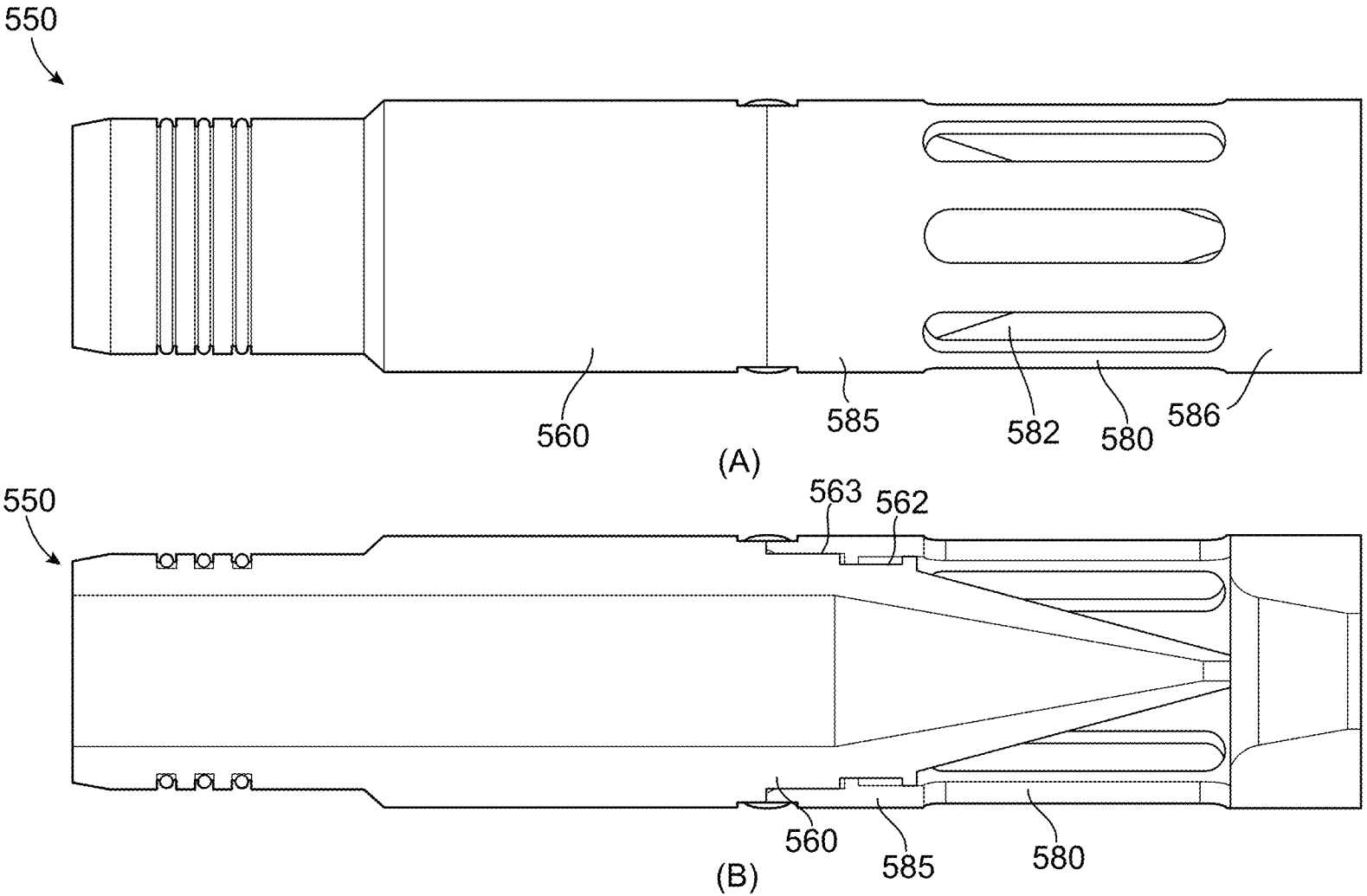
FIG. 9 shows a nozzle and diffuser assembly for fitting within the multi-channel ejector device of FIG. 7

FIGS. 8 and 9 show an example where the nozzle-diffuser assemblies 550 are configured to allow for thermal expansion. The upstream end of each of the nozzle-diffuser assemblies 550 locates within a bore in the supporting wall 521. The upstream end of each of the nozzle-diffuser assemblies 550 is axially spaced from a constraining surface (e.g. any radial surface or feature). This provides an axial gap 590 to allow for thermal expansion of the nozzle-diffuser assemblies 550. During operation, the nozzle-diffuser assemblies 550 can safely expand into this gap. This minimises problems which can arise when expansion is constrained, such as distortion of the nozzle-diffuser assemblies or an offset in the angular alignment of the nozzle and the diffuser.

The nozzle-diffuser assemblies 550 include a deflector vane or blade 565. The deflector vanes/blades 565 impart a rotational force to the motive fluid flowing along the nozzle channel 551. These deflector vanes/blades are described in more detail in WO 2018/130818 A1.

FIG. 9 shows some detail of a connection between an upstream end of the connecting structure 580 and the nozzle 560. The connecting structure 580 has a collar 585 at the upstream end and a collar 586 at the downstream end. The collars 585, 586 are regions which are free of apertures 582. The collar 585 surrounds a neck portion 562, 563 of the nozzle 560. In this example, the neck portion 562, 563 has a smaller diameter than the remainder of the nozzle 560 upstream (to the left) of the neck portion. During assembly of the nozzle-diffuser assembly 550, the collar 585 of the connecting structure 580 is fitted around the neck portion 562, 563 of the nozzle 560. The collar 585 and the neck portion 562, 563 are coaxial. The nozzle-diffuser assembly 150 can also use a similar type of connection between the connecting structure 180 and nozzle 160.

Figure 10:
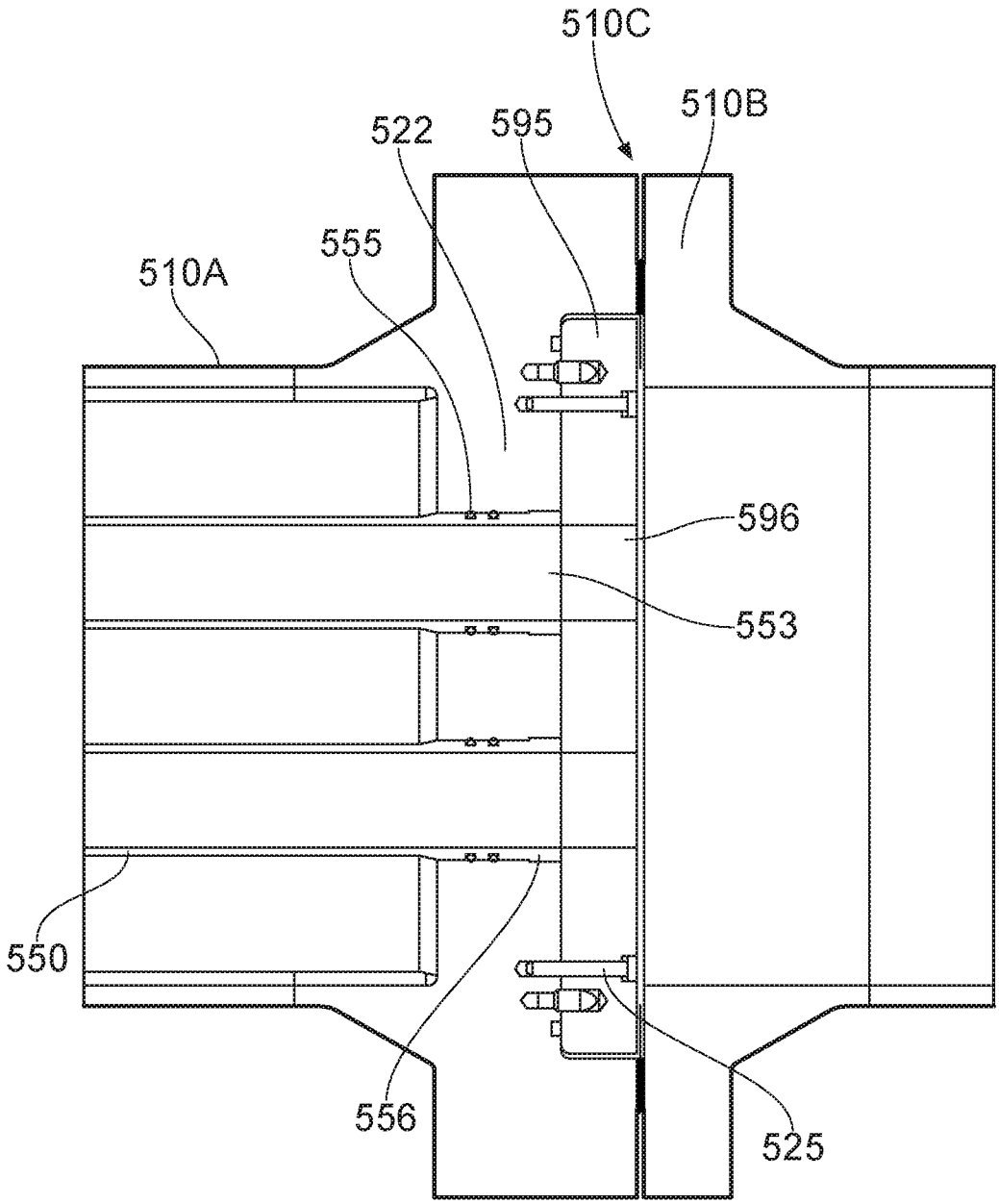
FIG. 10 shows a downstream end of the multi-channel ejector device of FIG. 7.

FIG. 10 shows a cross-section through the multi-channel ejector device 500 in the region of the downstream ends of the nozzle-diffuser assemblies 550. Each nozzle-diffuser assembly 550 has a flange 556 at the downstream end. The flange 556 locates within a recess in the supporting wall 522. The nozzle-diffuser assembly 450 can be inserted into the housing until the flange 556 engages with a "stop" defined by a surface of the supporting wall 522. A plate 595 extends across the downstream ends of the plurality of nozzle-diffuser assemblies 550. The plate 595 has a plurality of apertures 596 which extend through the plate. The apertures 596 are located at positions which align with the outlets 553 of the individual nozzle-diffuser assemblies 550. The plate 595 has a function of retaining the plurality of nozzle-diffuser assemblies 550. Fixings 525 secure the plate 595 to the supporting wall 522 of the housing. In this example, the plate 595 extends radially beyond the plurality of nozzle-diffuser assemblies 550 and forms part of the flange of the housing. When the second housing part 510B is coupled to the first housing part 510A (as shown in FIG. 10), an axially-directed force is exerted on the plate 595 which is transmitted to the downstream ends of the nozzle-diffuser assemblies. This reduces stress on the fixings 525, which are shown as a first set of fixation members and a second set of longer fixation members in FIG. 10.

Removal of the nozzle-diffuser assemblies 550 will now be described. The second housing part 510B is disconnected from the first housing part 510A at joint 510C. This provides access to plate 595. Plate 595 is removed. This provides clear access to the downstream ends of the plurality of nozzle-diffuser assemblies 550. An individual nozzle-diffuser assembly 550 can be removed from the housing. The selected nozzle-diffuser assembly 550 can then be withdrawn, as a single assembly, from the interior of the housing. Once the nozzle-diffuser assembly 550 has been withdrawn from the housing, it can be inspected (e.g. for routine maintenance, cleaning etc.) and re-inserted into the housing. Alternatively, the nozzle-diffuser assembly 550 which has been withdrawn from the housing may be replaced with a different nozzle-diffuser assembly 550. Other nozzle-diffuser assemblies 550 may be operated upon in the same way. Finally, the plate 595 is attached to the first housing part 510A and then the second housing part 510B is reconnected to the first housing part 510A at joint 510C.

The multiple-channel examples of FIG.6 and FIGS. 7-10 comprise a first supporting wall 421, 521 and a second supporting wall 422, 522. It is possible to provide one or more additional supporting walls. More walls is less desirable as it increases the quantity of material required, increases weight and makes it more difficult to insert and withdraw nozzle-diffuser assemblies.

Applications

An ejector of the type described above may be applied in a wide variety of practical applications involving the pumping of a wide variety of "suction" fluids, e.g. gaseous phases, by a wide variety of "motive" fluids, e.g. liquid phases. Various forms of gas compression are especially useful applications. By way of non-limiting examples, some practical applications in which ejector devices may be usefully employed may include any of the following:

(i) Water treatment applications:
- entraining ozone, chlorine or other disinfectant gas for disinfection of water used for e.g. swimming pools, cooling towers, bottling plants, etc;
- entraining atmospheric air for transferring oxygen to remove irons and manganese from borehole water;
- entraining atmospheric air for filtering backwashing and/or scouring of filter media.

(ii) Oil and gas industry applications:
- entraining vent gas;
- de-aeration of seawater;
- entraining header gas for oil/water separation;
- flare gas recovery.

(iii) Effluent treatment applications:
- entraining atmospheric air for transferring oxygen for sewage treatment;
- entraining atmospheric air for transferring oxygen for chemical oxidising purposes;
- entraining atmospheric air for aerating and mixing balance tanks;
- entraining pressurised air for producing "white water" on DAF (dissolved air flotation) plants.

(iv) Process applications:
- entraining $CO_2$ for carbonating soft drinks;
- simultaneous scrubbing and pumping of corrosive gases;
- scrubbing and neutralising of sour gas (e.g. using amines);
- recycling and mixing off-gas with motive liquor for increasing contact time and thus enhancing process reactions.

Other practical applications for particular embodiments or examples of the invention, in addition to those exemplified above, may also be available.

Thus, in some non-limiting practical examples of the use of ejector devices according to embodiments, any of the following combinations of liquid phase (as the "motive" fluid) and gaseous phase (as the "suction" fluid to be pumped) may be used:

(a) sea water—hydrocarbon(s) (gaseous; single or mixtures thereof);
(b) produced water—hydrocarbon(s) (gaseous; single or mixtures thereof);
(c) water—chlorine;
(d) water—ozone;
(e) water—air;
(f) corn syrup—$CO_2$;
(g) amine(s)—$CO_2$;
(h) amine(s)—hydrocarbon(s) (gaseous; single or mixtures thereof);
(i) amines(s)—sour gas;
(j) sewage—air;
and various other specific liquid—gas combinations.

It is to be understood that the above description of various specific embodiments of the invention has been by way of non-limiting examples only, and various modifications may be made from what has been specifically described and illustrated whilst remaining within the scope of the invention as defined by the appended claims.

Throughout the description and claims of this specification, the words "comprise" and "contain" and linguistic variations of those words, for example "comprising" and "comprises", mean "including but not limited to", and are not intended to (and do not) exclude other moieties, additives, components, integers or steps.

Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith.

The invention claimed is:

1. An ejector device comprising:

a housing having a motive fluid inlet to receive motive fluid, a suction fluid inlet to receive suction fluid and a fluid outlet to output the motive fluid and the suction fluid, wherein the housing comprises a first housing member releasably coupled to a second housing member, wherein the first housing member comprises a first end portion and an opposing second end portion with a chamber therebetween, wherein the motive fluid inlet is positioned at the first end portion of the first housing member; and a plurality of nozzle and diffuser assemblies configured to fit within the chamber of the housing, wherein each of the nozzle and diffuser assemblies comprises:

a nozzle;

a diffuser; and a connecting structure connecting the nozzle to the diffuser, the connecting structure configured to permit fluid flow between the nozzle and the diffuser, the connecting structure having apertures configured to allow the suction fluid to be drawn into the fluid flow between the nozzle and the diffuser, wherein the first housing member comprises a first supporting wall and a second supporting wall, wherein each of the first supporting wall and the second supporting wall extends radially across the chamber, the first supporting wall and the second supporting wall axially spaced apart along the first housing member, each of the first supporting wall and the second supporting wall having a plurality of bores configured to receive the plurality of the nozzle and diffuser assemblies, wherein an upstream end of each one of the plurality of nozzle and diffuser assemblies is located within a respective one bore of the plurality of bores in the first supporting wall with an axial space upstream of the upstream end and configured to allow for thermal expansion of the nozzle and diffuser assemblies into the axial space, wherein the second supporting wall comprises a projection that extends radially outward from the chamber and defines an external flange of the second end portion of the first housing member, and wherein the nozzle and diffuser assemblies are individually slidably removable from the second end portion of the first housing member when the second housing member is detached therefrom.

2. The ejector device according to claim 1 wherein the connecting structure is configured to concentrically align the nozzle and the diffuser about a longitudinal axis of a respective nozzle and diffuser assembly of the plurality of nozzle and diffuser assemblies, wherein the second supporting wall comprises a recess facing outward, away from the chamber, wherein the ejector device further comprises a plate held in the recess, and wherein the recess and the plate have a width, measured in a direction perpendicular to an axial direction of the chamber, that is less than an outer diameter of the external flange.

3. The ejector device according to claim 1 wherein the connecting structure is a hollow tubular structure that surrounds an end portion of the nozzle and an end portion of the diffuser.

4. The ejector device according to claim 1 wherein the apertures are located around a perimeter of the connecting structure.

5. The ejector device according to claim 4 wherein the diffuser has an inlet with an inlet cross sectional area and the apertures have a combined aperture cross sectional area, and wherein the combined aperture cross sectional area is equal to, or greater than, the inlet cross sectional area.

6. The ejector device according to claim 1 wherein the connecting structure comprises at least one of: (i) a collar free of apertures at an upstream end of the connecting structure; (ii) a collar free of apertures at a downstream end of the connecting structure.

7. The ejector device according to claim 1 and further comprising at least one sealing element to form a fluid-tight seal between each nozzle and diffuser assembly of the plurality of nozzle and diffuser assemblies and an interior of the housing.

8. The ejector device according to claim 7 wherein the at least one sealing element is carried by the plurality of nozzle and diffuser assemblies.

9. The ejector device according to claim 2 wherein the plate is configured to fit across a respective downstream end of the plurality of nozzle and diffuser assemblies, and wherein the plate comprises a plurality of apertures which extend through the plate, aligned with the bores of the second supporting wall.

10. The ejector device according to claim 9 further comprising:

a first set of fixation members having a first length that extend axially toward the chamber into an outer facing end of the second end portion of the first housing member, from an inner facing end of the plate, to couple the plate to the second end portion of the first housing member; and a second set of fixation members having a second length greater than the first length of the first set of fixation members that extend axially and releasably couple the second housing member to the first housing member.

11. The ejector device according to claim 1 wherein the suction fluid inlet is axially offset from the apertures of the connecting structures of the plurality of nozzle and diffuser assemblies.

12. The ejector device according to claim 1 wherein the housing has an unobstructed interior volume in the chamber between the first supporting wall and the second supporting wall.

13. The ejector device according to claim 1 wherein the first housing member is configured to releasably couple to the second housing member at a joint, and wherein the second supporting wall is located adjacent the joint.

14. An ejector device comprising:

a housing having a motive fluid inlet to receive motive fluid, a suction fluid inlet to receive suction fluid and a fluid outlet to output the motive fluid and the suction fluid, wherein the housing comprises a first housing member releasably coupled to a second housing member, wherein the first housing member has an axial length that is greater than an axial length of the second housing member, and wherein the first housing member comprises a first end portion and an opposing second end portion with a chamber therebetween; and a plurality of nozzle and diffuser assemblies configured to fit within the chamber, wherein each of the nozzle and diffuser assemblies comprises:

a nozzle;

a diffuser; and a connecting structure connecting the nozzle to the diffuser, the connecting structure configured to permit fluid flow between the nozzle and the diffuser, the connecting structure having apertures configured to allow the suction fluid to be drawn into the fluid flow between the nozzle and the diffuser, wherein the first housing member comprises a first supporting wall and a second supporting wall, wherein each of the first supporting wall and the second supporting wall extends radially across the chamber, the first supporting wall and the second supporting wall axially spaced apart along the first housing member, each of the first supporting wall and the second supporting wall having a plurality of bores configured to receive the plurality of the nozzle and diffuser assemblies, wherein the second end portion of the first housing member provides the second supporting wall whereby an external flange of the second end portion of the first housing member merges radially inward into the second supporting wall, wherein each bore of the plurality of bores of the first supporting wall has an axial length, wherein one bore of the plurality of bores of the first supporting wall cooperates with a respectively aligned nozzle and diffuser assembly of the plurality of nozzle and diffuser assemblies to provide a respective axial space at an upstream end portion of the one bore and that is upstream of an ups tream end of the respectively aligned nozzle and diffuser assembly of the plurality of nozzle and diffuser assemblies to allow for thermal expansion of the each nozzle of the nozzle and diffuser assemblies into the respective axial space thereby allowing for thermal expansion relative to the first supporting wall, and wherein the nozzle and diffuser assemblies are individually removable from a downstream end of the first housing member when decoupled from the second housing member, wherein the second supporting wall comprises a recess facing outward, away from the chamber, wherein the ejector device further comprises a plate held in the recess, and wherein the recess and the plate have an outer diameter that is less than an outer diameter of the external flange.

15. The ejector device of claim 14, wherein the external flange at the second end portion of the first housing member releasably couples to an adjacent external flange in the second housing member.

16. An ejector device comprising:

a housing having a motive fluid inlet to receive motive fluid, a suction fluid inlet to receive suction fluid and a fluid outlet to output the motive fluid and the suction fluid, wherein the housing comprises a first housing member releasably coupled to a second housing member, wherein the first housing member has an axial length that is greater than an axial length of the second housing member, and wherein the first housing member comprises a first end portion and an axially opposing second end portion with a chamber therebetween; and a plurality of nozzle and diffuser assemblies configured to fit within the chamber of the first housing member, wherein each of the nozzle and diffuser assemblies comprises:

a nozzle;

a diffuser; and a connecting structure connecting the nozzle to the diffuser, the connecting structure configured to permit fluid flow between the nozzle and the diffuser, the connecting structure having apertures configured to allow the suction fluid to be drawn into the fluid flow between the nozzle and the diffuser, wherein the first housing member comprises a first supporting wall and a second supporting wall, wherein each of the first supporting wall and the second supporting wall have a plurality of bores sized and configured to receive the plurality of the nozzle and diffuser assemblies, wherein the second supporting wall is positioned adjacent the second end portion of the first housing member, wherein the nozzle and diffuser assemblies are individually removable from a downstream end of the first housing member when decoupled from the second housing member, wherein the second supporting wall comprises a recess facing outward, away from the chamber, wherein the ejector device further comprises a plate held in the recess, and wherein an external flange at the second end portion of the first housing member merges radially inward into the second supporting wall.

17. The ejector device of claim 16, wherein the external flange releasably couples to an external flange of the second housing member.

* * * * *